US006179752B1

(12) United States Patent
Chang

(10) Patent No.: US 6,179,752 B1
(45) Date of Patent: Jan. 30, 2001

(54) LINKAGE DEVICE FOR A STEPPING AND SWINGING EXERCISER

(76) Inventor: Shao-Tuan Chang, 5F-23, 70, Fu-Shing Road, Taoyuan (TW)

( * ) Notice: Under 35 U.S.C. 154(b), the term of this patent shall be extended for 0 days.

(21) Appl. No.: 09/339,018

(22) Filed: Jun. 23, 1999

(51) Int. Cl.[7] ..... A63B 22/04
(52) U.S. Cl. ..... 482/52; 482/53; 601/35
(58) Field of Search ..... 482/51, 52, 53, 482/57, 70, 79, 80, 111, 112; 434/247, 255; 601/33, 35

(56) References Cited

U.S. PATENT DOCUMENTS 5,545,111 * 8/1996 Wang et al. ..... 482/53
5,628,709 * 5/1997 Chen ..... 482/53

* cited by examiner

*Primary Examiner*—Stephen R. Crow
*Assistant Examiner*—Tam Nguyen
(74) *Attorney, Agent, or Firm*—Dougherty & Troxell

(57) ABSTRACT

A linkage device for a stepping and swinging exerciser, the stepping and swinging exerciser including a base, a transversely disposed handle, a stepper, and a swinging linkage device. The swinging linkage device is secured at a front end of the base. The stepper has a pair of foot pedals and a pair of hydraulic cylinders pivotally provided on a securing shaft and a support shaft of a support body of the swinging linkage device. The support body of the swinging linkage device accommodates therein an upright bar and a bearing. The bearing is secured to the base. The upright bar passes through a shaft hole of the support body. A steering rod is disposed on one side of the upright bar. The upright bar has a top end projecting from the support body and has a generally U-shaped mounting seat for mounting of the handle. A lower front section of each of the foot pedals of the stepper is provided with a longitudinally disposed press seat, which has a bottom portion configured to have an oblique angle and secured to a bottom rod. The press seat and the bottom rod are accommodated behind the steering rod of the upright bar. When the stepper is actuated, the bottom rods of the foot pedals will urge against the steering rod to drive the upright bar to rotate on the bearing, thereby causing the handle to reciprocate from side to side. Hence, the user can exercise his/her upper trunk while performing stepping exercise.

2 Claims, 6 Drawing Sheets

LINKAGE DEVICE FOR A STEPPING AND SWINGING EXERCISER

BACKGROUND OF THE INVENTION (a) Field of the Invention

The present invention is related to a swinging linkage device disposed between a stepper and an upright bar of a stepping exerciser, more particularly to an exerciser that, by means of a linkage device that drives the upright bar and a handle to swing and turn, allows the user to twist his/her upper trunk while performing stepping exercise.

(b) Description of the Prior Art

Some existing steppers additionally provide a swinging function to allow users to swing their lower trunk while performing stepping exercise. However, as the upright bar and the handle of the stepper are fixed, users can hardly exercise their arms and upper trunk. Prior patents have taught exercisers that allow exercising of the arms by providing two handlebars that can swing back and forth. Exercisers of this type allow users to swing their arms back and forth as if running while performing stepping exercise, but they do not permit twisting of the upper trunk.

With reference to FIG. 1, U.S. Pat. No. 5,749,809 teaches a "Stepping and Swinging Exerciser" which includes a tube 14' and a handle 16' that can swing simultaneously. When the user steps on a foot pedal 21', a cable or chain 26' drives a pulley 25' at one end of a rod 23' to rotate. The other end of the rod 23' is connected to a bevel gear 24', which drives a bevel gear 17' and a pivot shaft 12' to rotate, thereby enabling the tube 14', which is secured to the pivot shaft 12', to swing therewith.

As the exerciser taught in said U.S. Pat. No. 5,749,809 employs indirect power transmission, the structure thereof is relatively complicated. Besides, the swinging action of the handle 16' can only allow the user to twist his/her waist and does not allow the user to swing his/her arms back and forth. Improvement thereon is therefore desirable.

SUMMARY OF THE INVENTION

A primary object of the present invention is to provide a swinging linkage device that employs direct transmission; that is simple in construction and easy to operate; and that allows the user to swing and exercise his/her upper trunk while performing stepping exercise.

Another object of the present invention is to provide a swinging linkage device that is disposed at a front end of a stepping and swinging exerciser and that cooperates with a transversely disposed handle to allow folding of the exerciser to save storage space and packaging material as well as facilitate transportation.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
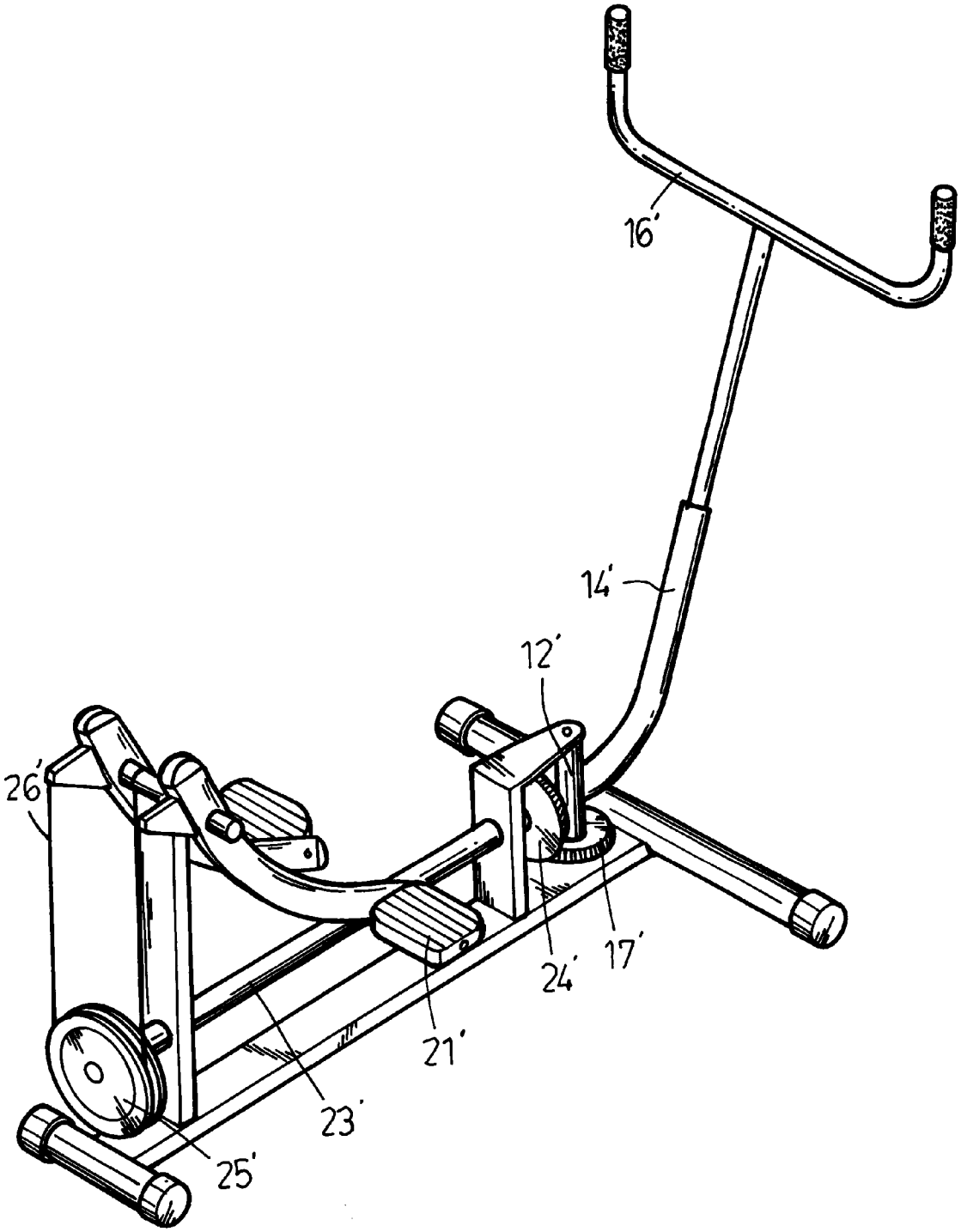
Prior Art FIG. 1
FIG. 1 is a perspective view of the stepping and swinging exercise disclosed in U.S. Pat. No. 5,749,809.
Figure 2:
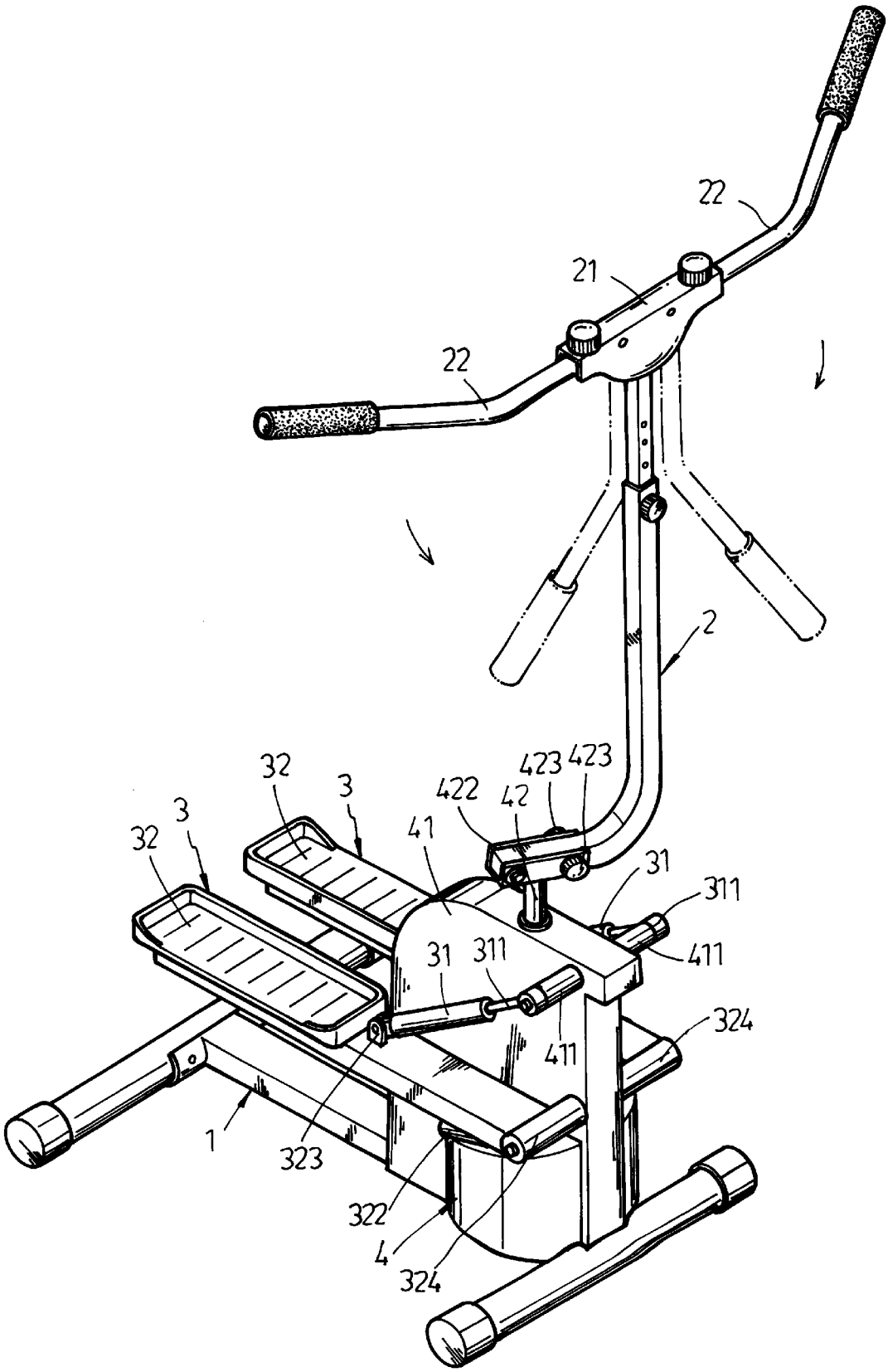
FIG. 2 is a perspective view of the present invention.
Figure 3:
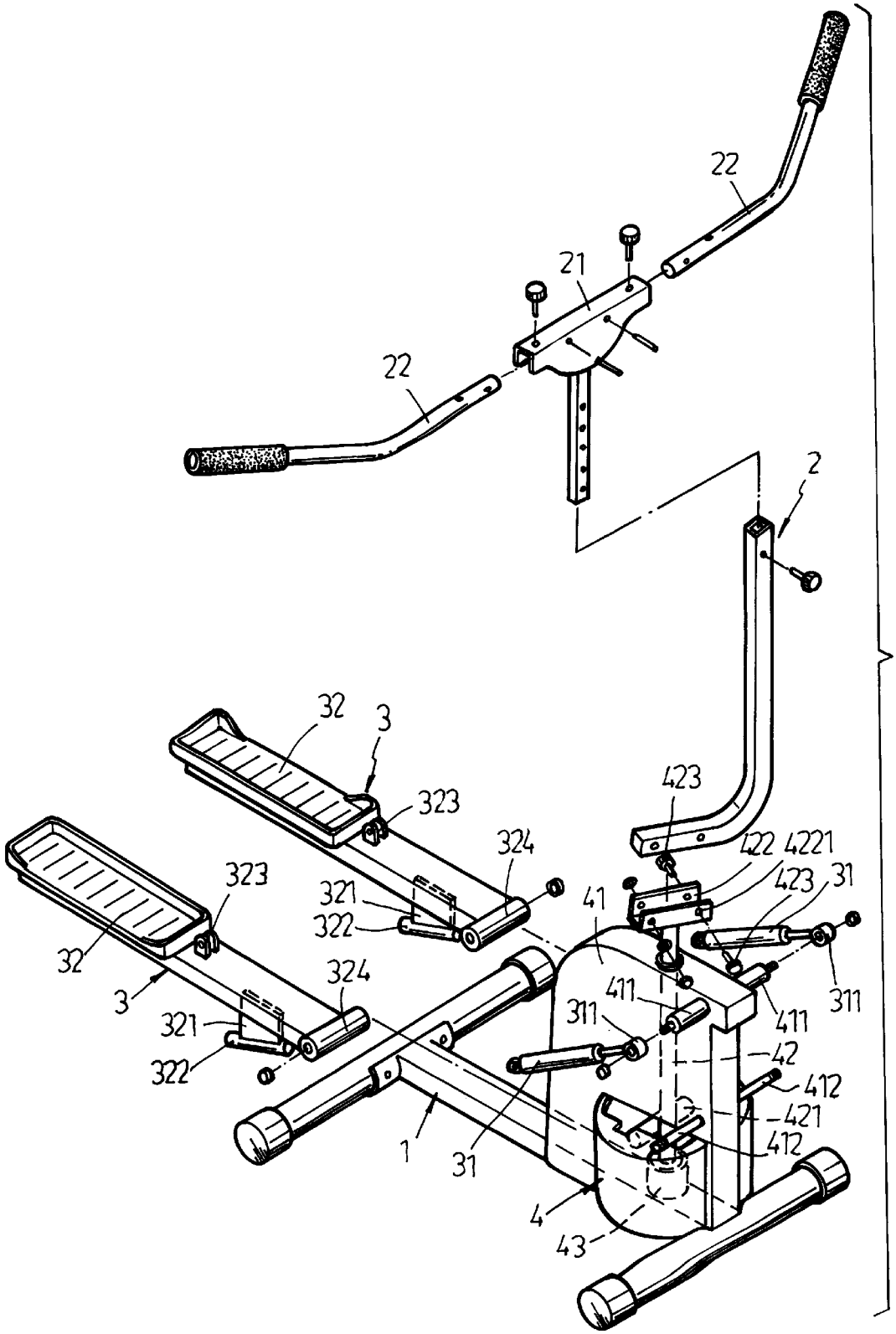
FIG. 3 is a perspective exploded view of the present invention.

With reference to FIGS. 2 and 3, the stepping and swinging exerciser according to the present invention is shown to include a base 1, a transversely disposed handle 2, a stepper 3, and a swinging linkage device 4. The swinging linkage device 4 is fixedly provided at a front end of the I-shaped base 1 in a longitudinal direction, and includes a support body 41 that conceals and supports the components thereof within a relatively broad bottom portion. A securing shaft 411 and a support shaft 412 pass transversely through upper and intermediate ends of a front portion of the support body 41, respectively. The stepper 3 includes hydraulic cylinders 31 having a piston rod 311 at one end. The piston rods 311 are pivotally provided on the securing shaft 411. The other end of the hydraulic cylinder 31 is secured at a mounting portion 323 on each foot pedal 32 of the stepper 31. The foot pedals 32 have pivotal connecting sleeves 324 at front ends thereof that are pivotally mounted on the support shafts 412 such that the user can utilize the foot pedals 32 to perform up and down pedaling action.

The support body 41 of the above-mentioned swing linkage device 4 accommodates therein an upright bar 42 and a bearing 43. The bearing 43 is fixedly connected to the base 1, whereas the upright bar 42 passes through a shaft hole of the support body 41. The upright bar 42 has a steering rod 421 provided on a rear side thereof and has a top end projecting vertically from the support body 41. The top end of the upright bar 42 is provided with a substantially U-shaped mounting seat 422 for mounting of a lower section of the handle 2. The U-shaped mounting seat 422 is provided with two pairs of through holes 4221. The front pair of through holes 4221 secures the lower section of the handle 2 in a pivotal manner, while the rear pair of through holes 4221 enables the handle 2 to be secured on the mounting seat 422 or, when bolts 423 are removed, enables the handle 2 to pivotally turn with respect to the mounting seat 422.

Figure 4:
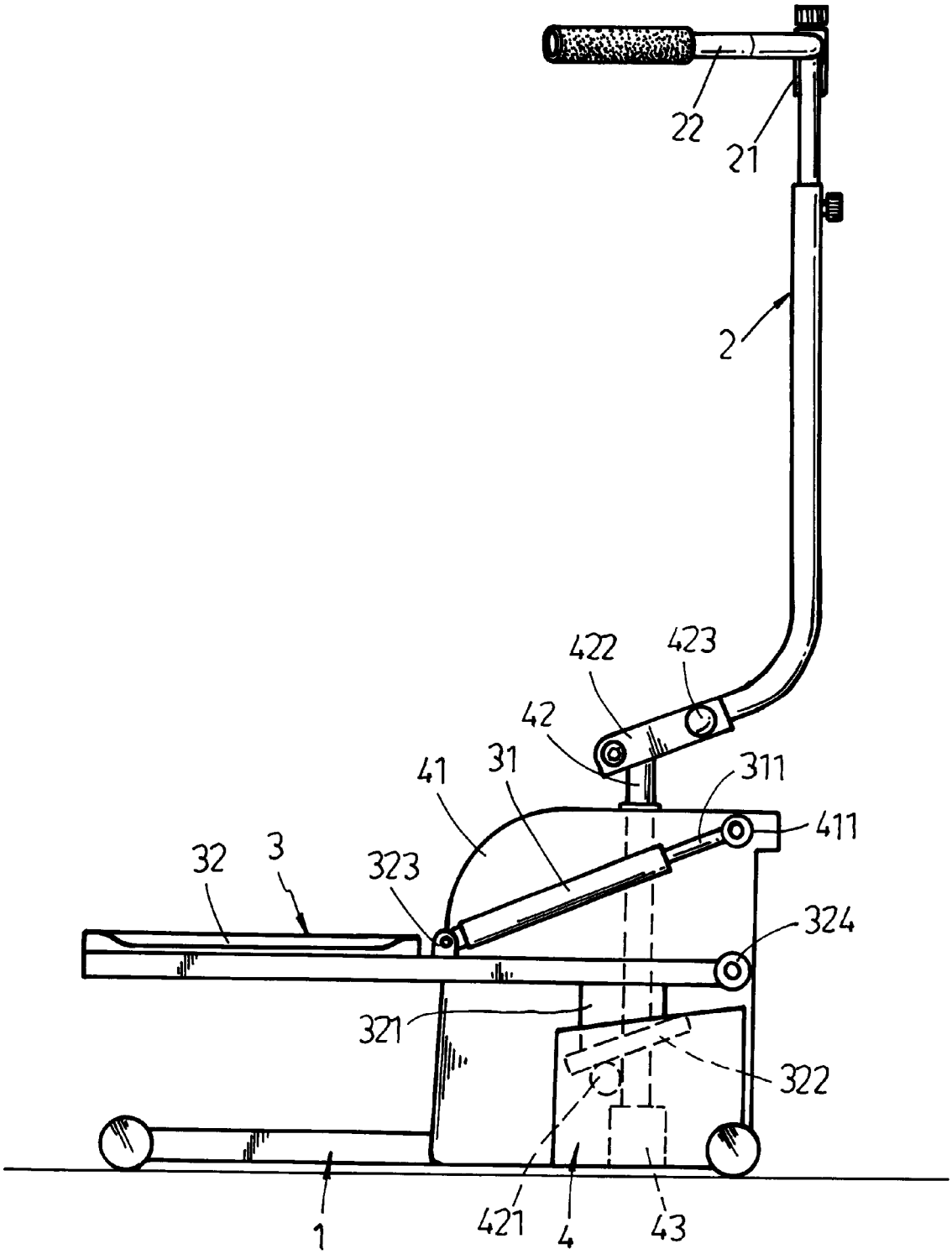
FIG. 4 is a side view of the present invention.

With reference to FIG. 4, a lower front section of each foot pedal 32 of the stepper 3 is provided with a longitudinally oriented press seat 321. The press seat 321 has a bottom portion configured to have an oblique angle and secured to a bottom rod 322. When the piston rods 311 are pivotally connected to the securing shaft 411, the press seats 321 and the bottom rods 322 of the foot pedals 32 are just located at the steering rod 421 of the upright bar 42 of the support body 41. Where the support body 41 receives the press seat 321 and the bottom rod 322, it is not enclosed and has a space adapted for swinging of the bottom rod 322 during operation.

Figure 5:
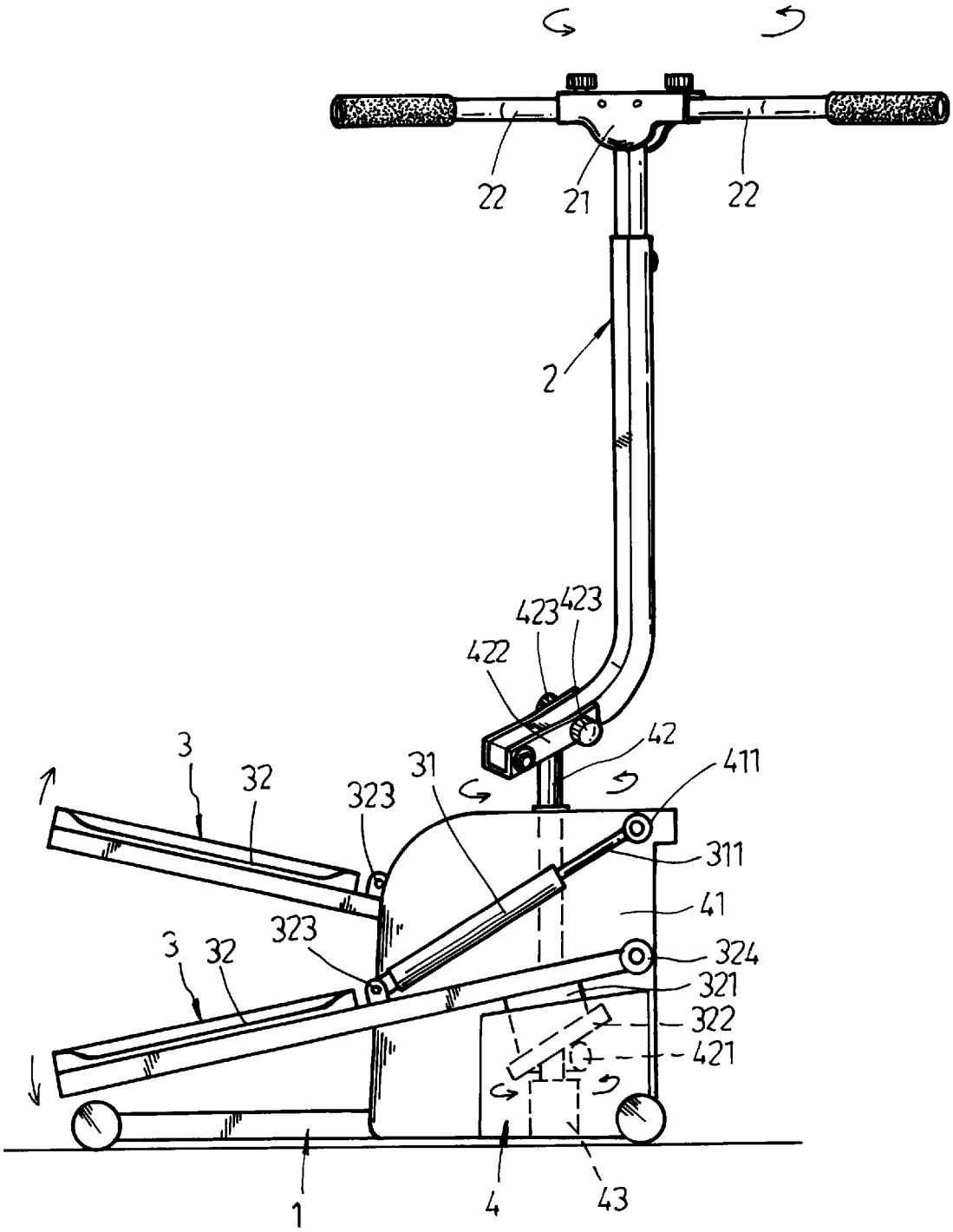
FIG. 5 is a schematic view illustrating the present invention in a state of use.

Referring to FIG. 5, during operation, when the right foot pedal 32 is pressed downwardly, the bottom rod 322 will urge against the steering rod 421 causing the latter to drive the upright bar 42 to turn on the bearing 43, further driving the handle 2 to swing to the left. In other words, when the left foot pedal 32 is pressed, the handle 2 will swing to the right. Hence, by means of the swinging linkage device 4 disposed between the stepper 3 and the upright bar 42, the user can, while performing stepping exercise, twist his/her upper trunk by means of the swinging linkage device 4 that drives the upright bar 42 and the handle 2 to turn or swing.

Figure 6:
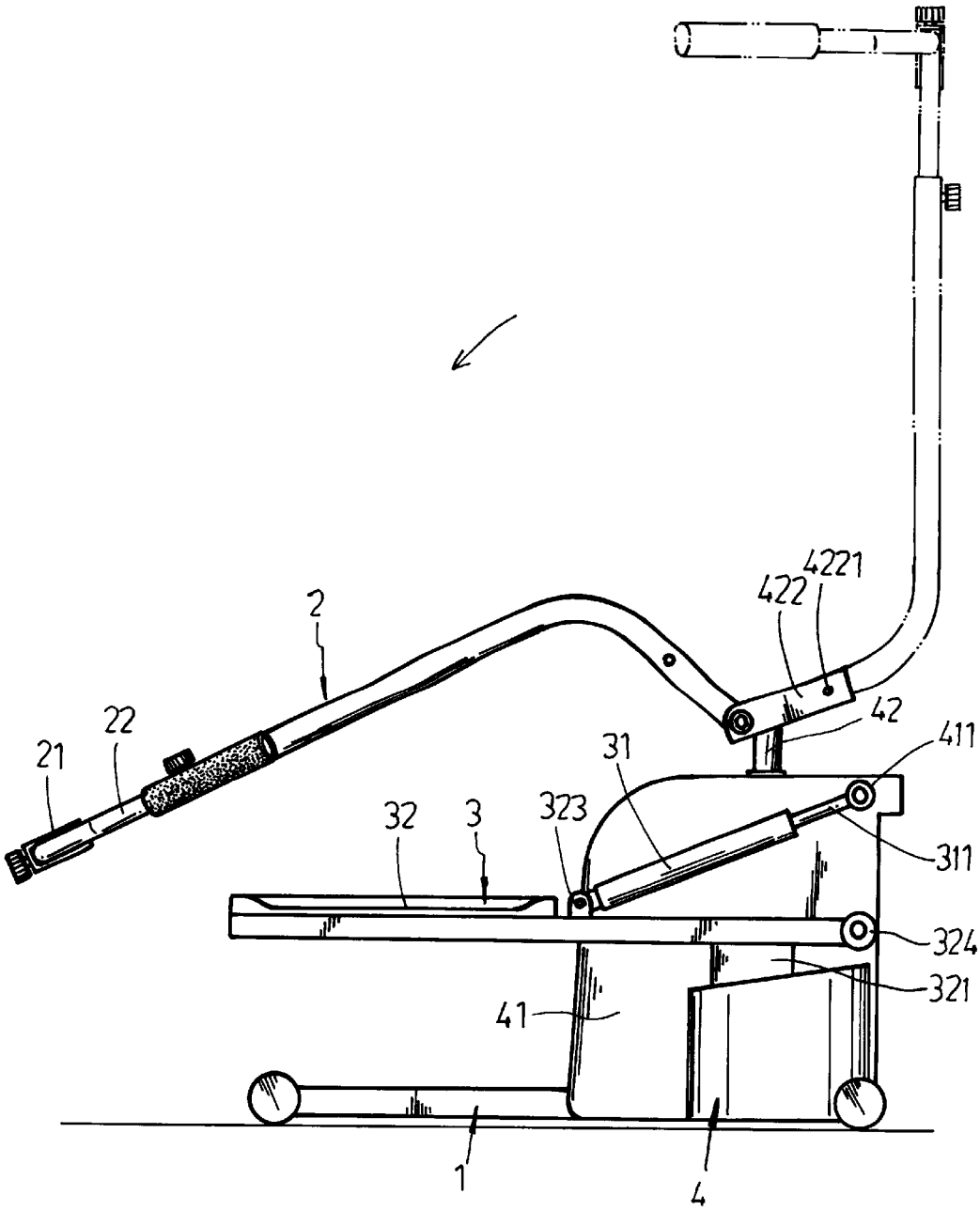
FIG. 6 is a schematic view illustrating the present invention in a folded state.

Referring to FIG. 6, the handle 2 includes a T-shaped adjusting support frame 21 and handlebars 22. By means of the adjusting support frame 21 and adjustment of bolts, the handlebars 22 are adapted for gripping by the user and, for storage purposes, can be closed downwardly for storage purposes, and the length of the body of the handle 2 and the adjusting frame 21 is adjustable to save space. Furthermore, due to the mounting seat 422 at the lower section of the handle 2, the handle 2 can be bent downwardly to facilitate storage, packaging and transportation.

In summary, the linkage device for stepping and swinging exercisers according to the present invention is not only simple in construction and easy to operate, it is also convenient to store and transport. Besides, it enables the user to perform stepping and swinging exercise at the same time.

Although the present invention has been illustrated and described with reference to the preferred embodiment thereof, it should be understood that it is in no way limited to the details of such embodiment but is capable of numerous modifications within the scope of the appended claims.

What is claimed is:

1. A linkage device for a stepping and swinging exerciser, comprising a base, a transversely disposed handle, a stepper, and a swinging linkage device, said swinging linkage device being secured at a front end of said base, said stepper having a pair of foot pedals and a pair of hydraulic cylinders pivotally provided on a securing shaft and a support shaft of a support body of said swinging linkage device, wherein said support body of said swinging linkage device accommodates therein an upright bar and a bearing, said bearing being secured to said base, said upright bar passing through a shaft hole of said support body, a steering rod being disposed on one side of said upright bar, said upright bar having a top end projecting from said support body and having a generally U-shaped mounting seat for mounting of said handle, a lower front section of each of said foot pedals of said stepper being provided with a longitudinally disposed press seat, said press seat having a bottom portion configured to have an oblique angle and secured to a bottom rod, said press seat and said bottom rod being accommodated behind said steering rod of said upright bar, whereby when said stepper is actuated, said bottom rods of said foot pedals will urge against said steering rod to drive said upright bar to rotate on said bearing, thereby causing said handle to reciprocate from side to side.

2. A linkage device for a stepping and swinging exerciser as defined in claim 1, wherein said mounting seat is provided with two pairs of through holes, said handle being mounted on or detached from said mounting seat by means of bolts.

* * * * *